US006788201B2

(12) United States Patent
Chen et al.

(10) Patent No.: US 6,788,201 B2
(45) Date of Patent: Sep. 7, 2004

(54) MOTION SENSITIVE SWITCH AND CIRCUITRY

(75) Inventors: Wen-Hsien Chen, Taipei (TW); Grant Tsao, City of Industry, CA (US); Alex Kotoff, City of Industry, CA (US)

(73) Assignee: Skechers U.S.A., Inc. II, Manhattan Beach, CA (US)

( * ) Notice: Subject to any disclaimer, the term of this patent is extended or adjusted under 35 U.S.C. 154(b) by 109 days.

(21) Appl. No.: 10/288,674

(22) Filed: Nov. 5, 2002

(65) Prior Publication Data

US 2004/0085216 A1 May 6, 2004

(51) Int. Cl.[7] ..... G08B 21/00

(52) U.S. Cl. ..... 340/540; 340/547; 340/483; 340/463; 340/464; 340/593; 335/205; 335/206; 335/207; 200/61.45 M; 200/61.52; 362/103; 362/200; 362/204; 362/276

(58) Field of Search ..... 340/540, 547, 340/483, 463, 464, 593; 335/205, 206, 207; 200/61.45 M, 61.52; 362/103, 200, 204, 276

(56) References Cited

U.S. PATENT DOCUMENTS

| | | | |
|---|---|---|---|
| 1,650,968 | A | 11/1927 | Tedeschi |
| 1,651,414 | A | 12/1927 | Settegast |
| 2,329,104 | A | 9/1943 | Chirelstein |
| 2,484,159 | A | 10/1949 | Flynn, Jr. |
| 2,802,204 | A | 8/1957 | Kennelly |
| 2,816,188 | A | 12/1957 | Stout |
| 3,073,922 | A | 1/1963 | Miller |
| 3,144,528 | A | 8/1964 | Pino |
| 3,270,159 | A | 8/1966 | Soos |
| 4,005,296 | A | 1/1977 | Olson |
| 4,104,492 | A | 8/1978 | Pliml, Jr. |
| 4,185,180 | A | 1/1980 | Anderson |
| 4,368,637 | A | 1/1983 | Anderson |
| 4,412,205 | A | 10/1983 | Von Kemenczky |
| 4,450,326 | A | 5/1984 | Ledger |
| 5,303,485 | A | 4/1994 | Golston et al. |
| 5,322,981 | A | 6/1994 | Grossi, III et al. |
| 5,343,190 | A | 8/1994 | Rodgers |
| 5,357,697 | A | 10/1994 | Lin |
| 5,371,662 | A | 12/1994 | Shen-Ko |
| 5,393,944 | A | 2/1995 | Manandhar |
| 5,396,720 | A | 3/1995 | Hwang et al. |
| 5,406,724 | A | 4/1995 | Lin |
| 5,408,764 | A | 4/1995 | Wut et al. |
| 5,419,061 | A | 5/1995 | Barrocas |
| 5,438,493 | A | 8/1995 | Tseng |
| 5,483,759 | A | 1/1996 | Silverman |
| 5,546,681 | A | 8/1996 | Goldston et al. |
| 5,599,088 | A | 2/1997 | Chien |
| 5,746,499 | A | 5/1998 | Ratcliffe et al. |
| 5,758,946 | A | 6/1998 | Chen |
| 5,866,987 | A | 2/1999 | Wut et al. |
| 5,903,103 | A | 5/1999 | Garner |
| 5,909,088 | A | 6/1999 | Wut et al. |

(List continued on next page.)

*Primary Examiner*—Daniel J. Wu
*Assistant Examiner*—Tai T. Nguyen
(74) *Attorney, Agent, or Firm*—Marshall A. Lemer, Esq.; Finn T. Simmensen, Esq.; Kleinberg & Lerner, LLP

(57) ABSTRACT

A motion sensitive device for causing an electronic signal to be sent to one or more output devices, comprising a printed circuit board, a battery connected to the printed circuit board, electrical circuitry connected to the printed circuit board, a motion sensitive switch connected to the printed circuit board, electrical output devices such as light emitting diodes connected to the printed circuit board and electrical circuits all providing means whereby the motion sensitive switch causes a signal to be transmitted to the output device when movement is sensed by the switch. The device is small enough to be used in wearing apparel and can provide safety vis-à-vis increased visibility for the user.

14 Claims, 3 Drawing Sheets

U.S. PATENT DOCUMENTS

| | | | |
|---|---|---|---|
| 5,932,975 | A | 8/1999 | Wut et al. |
| 5,955,957 | A | 9/1999 | Calabrese |
| 5,965,855 | A | 10/1999 | Tanazawa |
| 6,012,822 | A | 1/2000 | Robinson |
| 6,017,128 | A | 1/2000 | Goldston et al. |
| 6,065,851 | A | 5/2000 | So |
| 6,104,140 | A | 8/2000 | Wut et al. |
| 6,164,794 | A | 12/2000 | Rodgers |
| 6,238,056 | B1 | 5/2001 | Rapisarda |
| 6,280,045 | B1 | 8/2001 | Anteby et al. |
| 6,286,975 | B1 | 9/2001 | Rodgers |
| 6,354,712 | B1 | 3/2002 | Anteby |
| 6,402,336 | B1 | 6/2002 | Reese |
| 6,443,590 | B1 | 9/2002 | Lovitt |
| 6,447,144 | B1 | 9/2002 | Maxim |

MOTION SENSITIVE SWITCH AND CIRCUITRY

BACKGROUND OF THE INVENTION

1. Field of the Invention

The present invention relates generally to electric circuit apparatus and, more particularly, to motion or shock detecting apparatus in such devices and especially to triggers for novelty items, such as illuminated wearing apparel.

2. Description of the Related Art

In the field of novelty items, especially as they apply to wearing apparel and footwear, it is sometimes desirable to provide an article of manufacture with illumination and/or sound. Especially in the field of footwear, a shoe may incorporate one or more flashing lights for ornamentation, amusement or safety such as when the user is in proximity to automobile and other traffic. A device installed in such a shoe might incorporate one or more light-emitting diodes, a trigger mechanism, circuitry to both recognize trigger signals and to display varying illumination sequences and a battery for energizing the diode(s).

In order to maximize battery life, the diode(s) in the shoe should illuminate only when the user is active, such as when dancing, running, jumping, etc. The diode(s) should not illuminate when the shoe is "at rest". A shoe is at rest when it is either not being worn or is worn but the user's feet are inactive (such as when the user is sitting down). Accordingly, such a shoe might incorporate a trigger mechanism and switch to connect the diodes to the battery when pressure is applied or when the shoe is set in motion through impact, acceleration or otherwise.

Prior art in this area has developed along two lines: 1) the development of a trigger and circuit switching mechanism and 2) the development of increasingly complicated light displays and illumination patterns. A motivating factor in motion sensor development for apparel, toys and other such items, has been the constant pressure to reduce the costs and complexity of the sensor and switch mechanism. Most such devices include a method of biasing part of a circuit in a position that creates either an open or a closed circuit. Movement causes that piece of the circuit to move away from its biased position, thus closing or opening the circuit based upon the prior position of the device. The change in state from open to closed, or closed to open, triggered the targeted event.

The state of earlier prior art technology is demonstrated in U.S. Pat. No. 6,087,951 (the '951 patent), to Ramsden. That technology uses a fixed magnet, a moveable magnet and an activator switch. The moveable magnet is biased such that it rests in contact with the fixed magnet. A pre-defined amount of force caused by movement, is sufficient to caused the moveable magnet to move away from the fixed magnet, sliding towards an activator switch. The moveable magnet pushes the activator switch with sufficient force to trigger the switch.

Some of the disadvantages of that type of design are described in U.S. Pat. No. 5,965,855 (the '855 patent), by Tanazawa. According to the '855 patent, the moveable magnet design requires a relatively large amount of force to activate the sensor switch and correspondingly larger equipment to sense the activation of the switch. The '855 patent incorporates a metal ball enclosed in a chamber and surrounded by four parallel electrode pins. The ball is biased by a magnet. Movement breaks the contact between the ball and the magnet and allows the ball to contact two of the electrode pins. Contact between the metal ball and the electrode pins completes a circuit and triggers a change of state signal. The pins are positioned such that contact between any two pins defines upward, downward, right and left movements.

The second area of development regards the nature of the light displays. Technology in this area started with the display of a single light and later advanced to display a row of lights, blinking in a defined sequence. This prior art further developed to the point of pseudo-animation by having different scenes portrayed on a film attached to the shoe. A series of lights flash behind the scenes to cause the entirety of the graphical presentation on the shoe to appear animated.

Such a shoe incorporates several lights and an automatic circuit for flashing the lights in a desired sequence. One example of such a shoe is found in U.S. Pat. No. 5,457,900. This shoe can flash a fixed message, such as "hi". Another example is found in U.S. Pat. No. 6,112,437 (the '437 patent), issued to Lovitt, for An Article With Animated Display. This shoe displays light in a sequence that illuminates sequential panels of a film, to show a person running.

The combined goal of the two areas of development has been to make a switch device that is smaller, cheaper, has a longer battery life and produces an interesting and novel visual display. The present invention addresses each of these development goals.

SUMMARY OF THE INVENTION

It is an object of the present invention to provide a motion sensitive switch that can be used in apparel, small devices and toys and that is cheaper and better than currently existing motion sensitive switches. It is a related object to provide circuitry to accompany the switch that allows for multiple patterns of random and ordered output.

In accordance with these objects and with others which will be described and which will become apparent, an exemplary embodiment of a motion sensitive switch in accordance with the present invention comprises a housing unit that contains, among its basic elements, a motion sensitive switch mechanism, a battery and electrical circuitry.

The switch mechanism is contained within a smaller housing unit and comprises a magnet, two electrically conductive contact strips/pins (one being positively charged and the other being negatively charged) and an electrically conductive ball. The pins or contact strips are positioned between the magnet and the ball. The magnetic attraction biases the ball towards the magnet and into contact with the pins. Because the ball is electrically conductive, it completes a circuit between the two pins. Thus, in the biased position, the circuit is closed.

On motion, the contact between the pins and the ball is temporarily broken and the ball moves away from the electrically conductive pins. The circuit is broken and a change of state signal is sent to the electrical circuitry. When the ball again makes contact with the contact strips, a second change of state signal is sent. Upon receipt of the second change of state, the electrical circuitry activates the output device. The output device could be based upon illumination, audio output, any other form of electrically stimulated output or a combination of these. When the switch comes to rest, the ball again moves to its biased position, creating a closed circuit that positions the switch to detect a new change of state sequence.

In another exemplary embodiment of a motion sensitive switch in accordance with the present invention, the sensor switch does not include a magnet. In this embodiment, the electrically conductive ball is magnetized and the pins are comprised of a Ferro-magnetic, electrically conductive material. The ball is therefore attracted to the pins. In its biased position, the ball is at rest against the pins. On motion, the magnetic attraction and the circuit are temporarily broken. On returning to the biased position, the circuit is re-established and the change of state triggers the output device.

It is an advantage of the present invention that the motion sensitive switch contains fewer components than prior art. It is therefore less expensive and provides less opportunity for functional failure. This invention therefore provides a means by which a motion sensor switch can be more economically placed in wearing apparel, shoes and small devices.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein.

DESCRIPTION OF THE PREFERRED EMBODIMENTS

A novel motion sensitive switch and electrical circuitry are described. In the following description, for the purposes of explanation, specific component arrangements and constructions and other details are set forth in order to provide a more thorough understanding of the present invention. It will be apparent to those skilled in the art, however, that the present invention may be practiced without these specific details. In other instances, well known manufacturing methods and structures have not been described in detail so as to refrain from obscuring the present invention unnecessarily.

Figure 1:
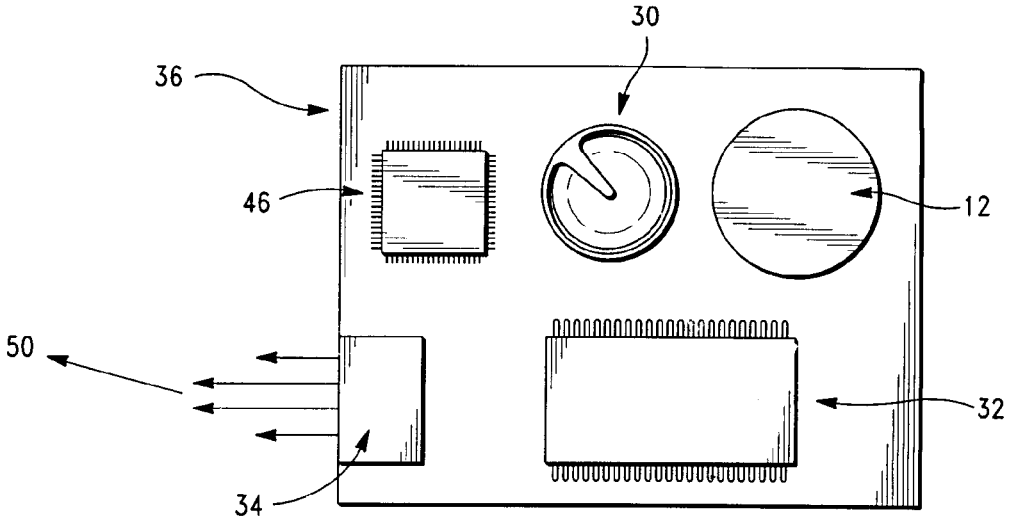
FIG. 1 is a top elevation of one embodiment of the printed circuit board showing the motion sensor switch, the battery housing, the circuits and the connectors to outside electrical devices.

Referring first to FIG. 1, the invention comprises several basic components including a motion sensor switch housing 10, a power source 30, electrical circuitry generally printed on a circuit board 36 and output device(s) 50 that generally comprise one or more illumination devices such as light emitting diodes. Additionally, the motion sensor switch housing 10, power source 30 and electrical circuitry generally printed on a circuit board 36 are positioned such that they are hidden from view, such as within the sole of a shoe, while the output device 50 is located such that the output is observable on the outside surface of the shoe.

Figure 2:
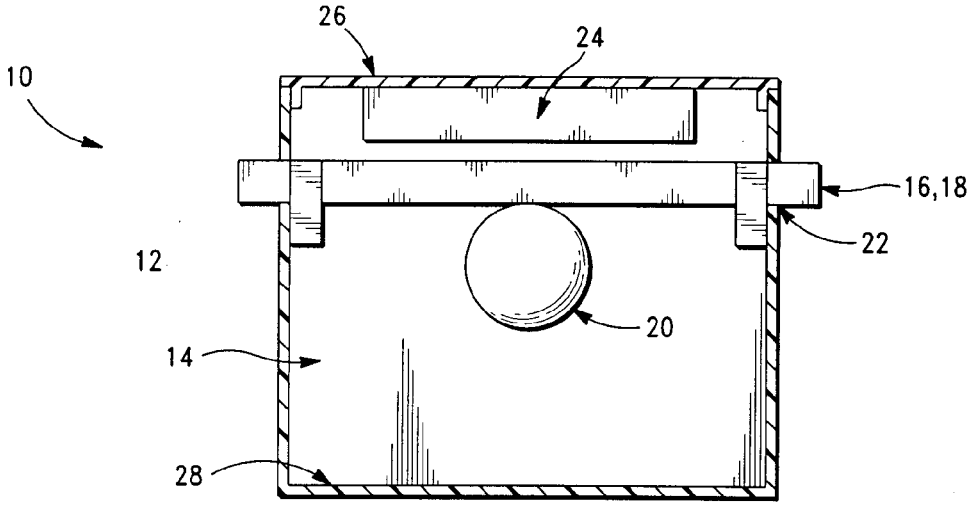
FIG. 2 is a cut away elevation of the motion sensor switch housing showing the motion sensor switch, the battery housing, the circuits and the connectors to outside electrical devices.
Figure 4:
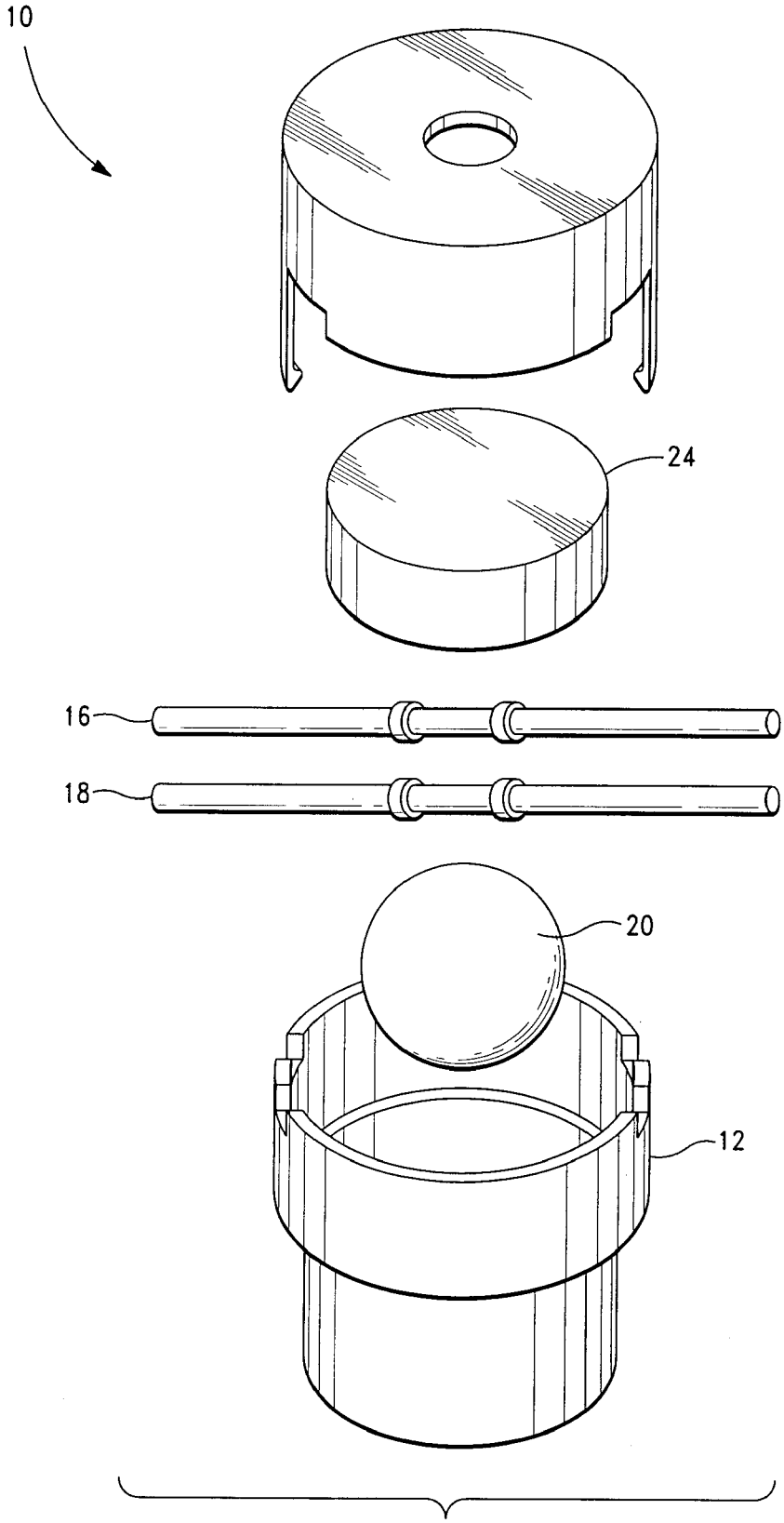
FIG. 4 is an exploded view of the motion sensor switch with a magnet.

Referring next to FIG. 2, which illustrates in cut-away elevation a preferred embodiment of a motion sensitive switch in accordance with the present invention shown generally by the reference number 10. In FIG. 2, the circuit is in a closed position, with a moveable object having an electrically conductive surface and a magnetically attractable portion, generically referred to herein as an electrically conductive ball 20, resting against two electrically conductive members (pins) supported in said housing 16, 18. Referring also to FIG. 4, an exploded view of the motion sensor switch 10 is shown.

The motion sensor switch 10 is contained within an electrically non-conductive housing unit 12. The switch 10 includes a positively charged electrically conductive pin 16, a negatively charged electrically conductive pin 18, an electrically conductive ball 20 and a magnet 24. The pins 16, 18 are connected to the circuit in such a manner that contact by the ball 20 concurrently with both pins 16, 18 forms a closed circuit. The magnet is positioned within the chamber so that it attracts the ball 20 towards and in contact with the pins 16, 18 when the device is inactive.

In one embodiment of the invention, the housing 12 is essentially cylindrical in shape, having a top surface 26 and an opposing bottom surface 28. When assembled, the magnet 24 is positioned within the housing 12 against the top surface 26. Two electrically conductive pins 16, 18 are positioned adjacent to the magnet 24 and between the magnet 24 and the bottom surface 28. Pins 16, 18 are positioned close enough together such that the ball 20 is not allowed to pass between the pins 16, 18 and is therefore not allowed to directly contact the magnet 24. The ball 20 is moveably positioned between the two pins 16, 18 and the bottom surface 28.

The height of the housing 12 is roughly equivalent to, but slightly greater than, the combined heights of the ball 20, the pins 16, 18 and the magnet 24. Thus, there is sufficient space between the pins 16, 18 and the magnet 24 such that the pins 16, 18 and the magnet 24 are not in contact with each other. Additionally, there is sufficient additional space between the pins 16, 18 and the bottom surface 28 such that when the ball 20 is in contact with the bottom surface 28, the ball 20 is not in contact with the pins 16, 18.

When the device 10 is at rest, the ball 20 is biased towards the magnet 24 and rests against the pins 16, 18. When the ball is in this position, the circuit is closed. When the device 10 moves, the motion produces sufficient force to break the magnetic bond between the ball 20 and the magnet 24, allowing the ball 20 to momentarily move freely within the housing unit 12. While the ball 20 is not in contact with the pins 16, 18, the circuit is open.

Figure 3:
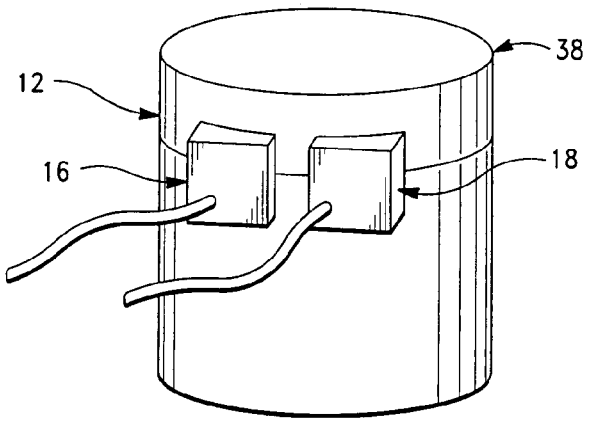
FIG. 3 is a perspective of the motion sensor switch with the electrically conductive pins extending outside of the housing and connected to the PC Board.

Referring next to FIG. 3, the two pins 16, 18 extend beyond the wall of the motion sensor housing 12 and are connected to the remaining electronic circuitry. To prevent movement, the pins 16, 18 rest in notches in the housing 12 when the switch 10 is fully assembled.

Figure 5:
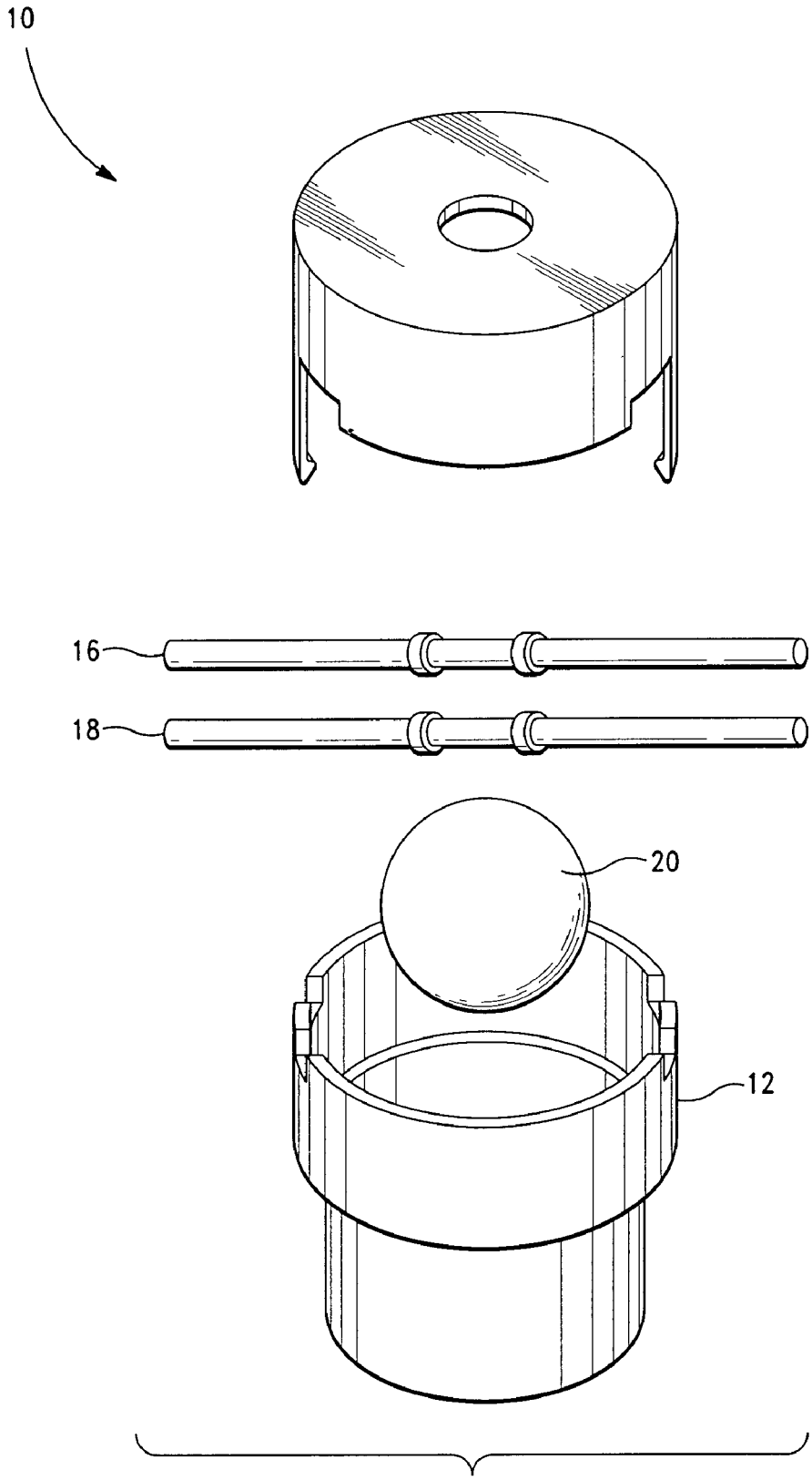
FIG. 5 is an exploded view of the motion sensor switch without a magent.

Referring next to FIG. 5, another embodiment of the motion sensitive switch 10 is shown. In this embodiment, the electrically conductive ball 20 is magnetized and is therefore attracted to the Ferro-magnetic, electrically conductive pins 16 and 18. In its biased position, the ball 20 is at rest against the pins, 16 and 18. On motion, the magnetic attraction of the ball 20 and the circuit are temporarily broken. On returning to the biased position, the circuit is re-established and the change of state, as described above, triggers the output device. This alternative embodiment is capable of carrying out its intended function of breaking and re-making the circuit in the absence of a separate magnet 24.

Another major component of the invention is the electrical circuitry, generally placed on a printed circuit board.

Referring also back to FIG. 1, the sensor switch housing is coupled to a printed circuit board 30. Also coupled to the printed circuit board 30 are a small battery 30, a microprocessor 46, memory, circuits 32 and connectors 34 for wiring to lights and/or other electrical devices. The change from closed to open causes a state change within the electrical circuitry. A second state change occurs when the ball 20 re-establishes contact with the pins 16, 18. The second state change causes a trigger signal to be sent to an output device 50. In the preferred embodiment, the output device 50 produces lights and/or sounds. In the case where the output device 50 comprises a series of lights, the trigger signal consisting of the two state changes closely timed together, causes the lights connected to the circuitry to illuminate.

The illumination pattern used in the preferred embodiment is an initial illumination pattern sequence followed by a second illumination pattern sequence. Starting from the end of the initial trigger cycle and within the defined "delay" period of two seconds, if any additional trigger signal is detected, the LED 50 will continue it's flashing sequence. When no additional trigger signals are present after the two second "delay" period, the microprocessor selects a random "end-cycle" pattern of either 1 or 2 additional flashing sequences (end-cycles) and return to stand-by mode until a new trigger occurs. This end cycle consists of two different flash duration's for the purpose of extending battery life: (i) one complete cycle (80% probability) or (ii) two complete cycles (20% probability).

In the preferred embodiment, the microprocessor 46 begins lighting the first LED 50 in response to a triggering event. The LEDs 50 illuminate in sequence, in a "lighting cycle," beginning with the LED 50 at one end of the strip and ending with the LED 50 at the opposite end. Each LED 50 turns off in sequence before the next LED 50 turns on. When the last LED 50 is turned off it creates the "end of the lighting cycle." If the triggering event still exists at the end of the cycle, the microprocessor 46 causes the beginning of another lighting cycle. If no triggering event exists at the end of the cycle, the microprocessor 46 selects and performs an "end cycle." The number of end cycles is selected according to a random process (done by the microprocessor 46) from the number {1, 2, or 3}, so that one, two, or three complete end cycles follow. Lighting stops at the end of the final end cycle.

In the preferred embodiment, several different flashing sequences are programmed into the electronic circuitry. The table below, identifies the flashing sequence of the preferred embodiment. The illumination pattern used in the preferred embodiment is a pre-defined initial signal sequence followed by a pre-defined sequential signal sequence followed by a randomly selected closing signal sequence. Only the last "randomly selected closing signal" was incorporated into the circuit design. However, it should be noted that the invention is not limited to these specific lighting sequences.

| REF NO. | LED's | SEQUENCE |
|---|---|---|
| RS3627B-5R-066-00A | 5 | 1&5>2&4>3>2&4>1&5>2&4>3>2&4>1&5 (end 9-flashes) > random end cycle |
| RS3627B-5R-066-00B | 5 | 1>2>3>4>5>4>3>2>1>2>3>4>5 (end 13-flashes) > random end cycle |
| RS3627B-3R-066-00C | 3 | 1>2>3>2>1>2>3>2>1 (end 9-flashes) > random end cycle |
| RS3627B-3R3G-066-00D | 6 | 1>2>3>4>5>6>1>2>3>4>5>6>1>2>3>4>5>6 (end 18-flashes) > random end cycle |

-continued

| REF NO. | LED's | SEQUENCE |
|---|---|---|
| RS3627-7R-200-00E | 7 | 1>2>3>4>5>6>7 (end 7-flashes) > random end cycle |

As noted above, the end cycle is randomly chosen from one of two different selections. The end cycle consists of two different flash duration's of either one or two complete cycles. In an embodiment where the output device(s) 50 consist of audio devices, the trigger signal causes a series of sounds to be emitted instead of illuminated LED output.

Now referring also to FIGS. 1 and 2, in the biased position, the metallic ball 20 will remain contacted against the pins 16 and 18. A trigger event occurs when the ball 20 moves away from and then re-contacts pins 16 and 18. The momentary break in continuity and the re-contact of the pins 16 and 18 forms the trigger cycle that the microprocessor 46 accepts in order to start the LED 50 flashing sequence. Each trigger cycle is considered to be "one-shot" or non-re-occurring. When the trigger cycle is completed and output is sent from the microprocessor 46, the LED's 50 will then begin to flash. To prevent the microprocessor 46 from processing multiple trigger inputs, any trigger input received between the "start" and "end" of a flash sequence is disregarded. After the end of a flash sequence, a "delay" period (defined in one embodiment to be between 0.02 and 2.0 seconds) will occur before the device will accept any new trigger inputs to start another flash sequence. If no trigger is received, microprocessor 46 will select a random end cycle to flash. During the end cycle, any trigger inputs are disregarded until the cycle is completed.

Upon triggering, the LEDs 50 will flash for a single cycle sequence. Starting from the end of the initial trigger cycle and within the defined "delay" period of two seconds, if any additional trigger signal is detected, the LED 50 will continue its flashing sequence. When no additional trigger signals are present after the "delay" period, the microprocessor 46 will then select a random "end-cycle" pattern of 1 or 2 additional flashing sequences and return to stand-by mode until a new trigger occurs.

The type of power source used in the preferred embodiment is a small battery. The exact type of battery is not significant to the invention except that it should be small enough to conveniently fit into the item to which the invention is attached. The type of electrical circuitry capable of functioning in the manner described is readily available and familiar to those in the industry.

While the foregoing detailed description has described several embodiments of a motion sensitive switch in accordance with the present invention, the above description is illustrative only and not limiting of the disclosed invention. Indeed, it will be appreciated that the embodiments discussed above and the virtually infinite embodiments that are not mentioned could easily be within the scope and spirit of the present invention. Thus, the present invention is limited only by the claims set forth below.

What is claimed is:

1. A motion sensitive device for causing an output signal responsive to movement, comprising:

housing;

a moveable object having an electrically conductive surface and a magnetically attractable portion and confined in said housing;

first and second electrically conductive members supported in said housing and positioned to confine said moveable object;

a magnetic body disposed proximate to said first and second electrically conductive members to magnetically bias said electrically conductive surface of said moveable object into electrical contact with said first and second electrically conductive members;

at least one electrical output device;

an electrical power source coupled to at least one of said electrically conductive members whereby an electrical circuit being defined in series by said electrical power source, said first electrically conductive member, said electrically conductive surface of said moveable object, said second electrically conductive member, and said electrical output device when said electrically conductive surface of said moveable object is biased into electrical contact with said first and second electrically conductive members;

said electrical circuit being opened in response to movement of said moveable object; and circuit means, operatively connected to said electrical circuit, for causing a signal to be sent to said electrical output device when the closed circuit is opened and then re-closed within a predetermined time interval.

2. The invention of claim 1 wherein said output signal sent to said at least one output device comprises an initial output signal sequence followed by a second sequential output signal sequence followed by a randomly selected closing output signal sequence with said selections being made from sequences available within said circuit means.

3. The invention of claim 1 wherein said circuit means additionally comprises a microprocessor and memory.

4. The invention of claim 1 wherein said output signal is initiated by a change of state defined as a series of electrical signals identifying, in sequence, a closed circuit, an open circuit and a closed circuit within said electrical circuit and within a predefined period of time.

5. The invention of claim 1 wherein said first and second electrically conductive members are positioned non-parallel to each other.

6. The invention of claim 1 wherein said at least one electrical output device consists of a plurality of light emitting diodes.

7. The invention of claim 1 wherein said at least one electrical output device consists of a plurality of audible devices.

8. A motion sensitive device for causing an output signal responsive to movement, comprising:

housing;

a moveable magnetic object having an electrically conductive surface and confined in said housing;

first and second magnetically attracted, electrically conductive members supported in said housing and positioned to confine said moveable object;

an electrical power source connected to at least one of said electro-conductive members;

said moveable object being disposed proximate to said first and second electrically conductive members to magnetically bias said electrically conductive surface of said moveable object into electrical contact with said first and second electrically conductive members;

at least one electrical output device connected to at least one of said electro-conductive members whereby an electrical circuit is defined in series by said electrical power source, said first electrically conductive member, said electrically conductive surface of said moveable object, said second electrically conductive member, and said electrical output device when said electrically conductive surface of said moveable object is biased into electrical contact with said first and second electrically conductive members;

said electrical circuit being opened in response to movement of said moveable object; and circuit means, operatively connected to said electrical circuit, for causing a signal to be sent to said electrical output device when the closed circuit is opened and then re-closed within a predetermined time interval.

9. The invention of claim 8 wherein said output signal sent to said at least one output device comprises an initial output signal sequence followed by a second sequential output signal sequence followed by a randomly selected closing output signal sequence with said selections being made from sequences available within said circuit means.

10. The invention of claim 8 wherein said circuit means additionally comprises a microprocessor and memory.

11. The invention of claim 8 wherein said output signal is initiated by a change of state defined as a series of electrical signals identifying, in sequence, a closed circuit, an open circuit and a closed circuit within a pre-defined period of time within said electrical circuit.

12. The invention of claim 8 wherein said first and second electrically conductive members are positioned non-parallel to each other.

13. The invention of claim 8 wherein said at least one electrical output device consists of a plurality of light emitting diodes.

14. The invention of claim 8 wherein said at least one electrical output device consists of a plurality of audible devices.

* * * * *